US006254486B1

(12) United States Patent
Mathieu et al.

(10) Patent No.: US 6,254,486 B1
(45) Date of Patent: Jul. 3, 2001

(54) GAMING SYSTEM EMPLOYING SUCCESSIVELY TRANSMITTED INFRA-RED SIGNALS

(76) Inventors: Michael Mathieu, 145 West Beaver Creek Road, Unit 1, Richmond Hill, Ontario (CA), L4B 1C6; Michael Sivan, Flat 3A, Tower 1, HKBU Staff Quarters, 22 Sui Wo Rd. Fo Tan, Shatin (HK)

( * ) Notice: Subject to any disclaimer, the term of this patent is extended or adjusted under 35 U.S.C. 154(b) by 0 days.

(21) Appl. No.: 09/490,202

(22) Filed: Jan. 24, 2000

(51) Int. Cl.[7] ..... A63F 9/24

(52) U.S. Cl. ..... 463/52; 463/51; 463/2; 446/456; 446/175

(58) Field of Search ..... 463/3, 52, 51, 463/50, 53; 446/435, 456, 424, 175, 130, 50, 7

(56) References Cited

U.S. PATENT DOCUMENTS 4,545,583 * 10/1985 Pearman et al. .
4,772,028 * 9/1988 Rockhold et al. .
4,930,019 * 5/1990 Chu .
4,938,483 * 7/1990 Yavetz .
5,100,153 * 3/1992 Welte .
5,127,658 * 7/1992 Openiano .
5,375,847 * 12/1994 Fromm et al. .
5,892,221 * 4/1999 Lev .
5,904,621 * 5/1999 Small et al. .
5,906,542 * 5/1999 Neumann .
6,007,401 * 12/1999 Cyrus et al. .
6,068,537 * 5/2000 Lupton .
6,071,166 * 6/2000 Lebensfeld et al. .

* cited by examiner

*Primary Examiner*—Michael O'Neill

(57) ABSTRACT

Disclosed is a gaming system which utilizes successively transmitted infra-red signals. The system includes two user controlled components which interact with one another. In the preferred embodiment, each component is made up of a hand-held controller and a robot. The controller has both directional controls and a fire control. When a fire control signal is initiated a signal is transmitted to the robot. Upon its reception, a new signal is generated and transmitted by the robot. In this manner, weapons fire is simulated.

6 Claims, 9 Drawing Sheets

FIG 3
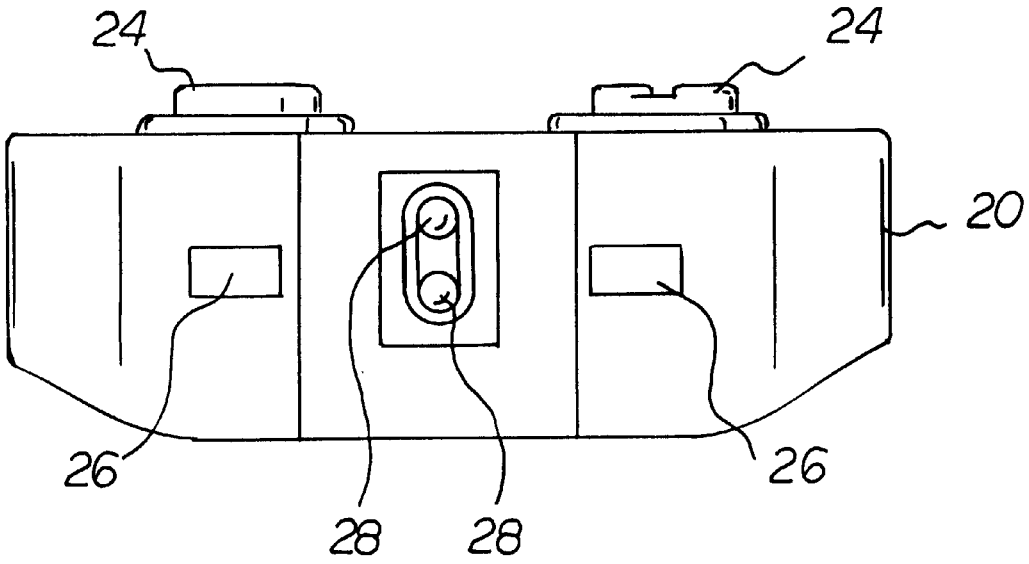
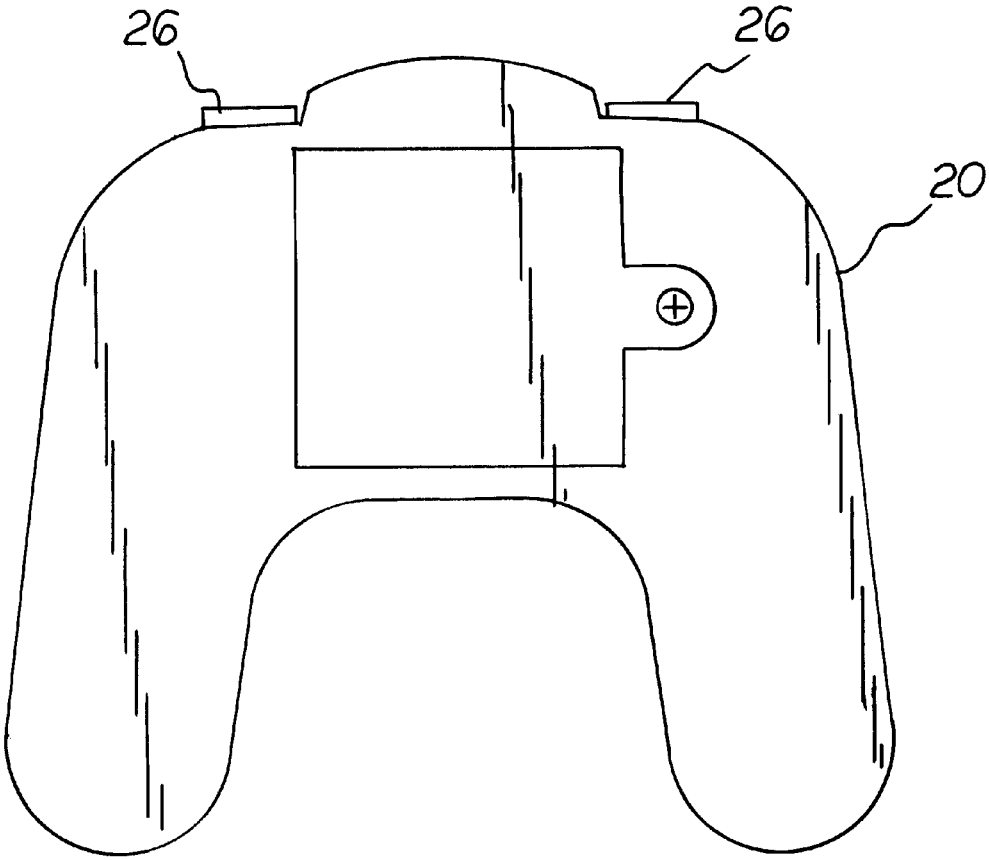
FIG 4

FIG 6
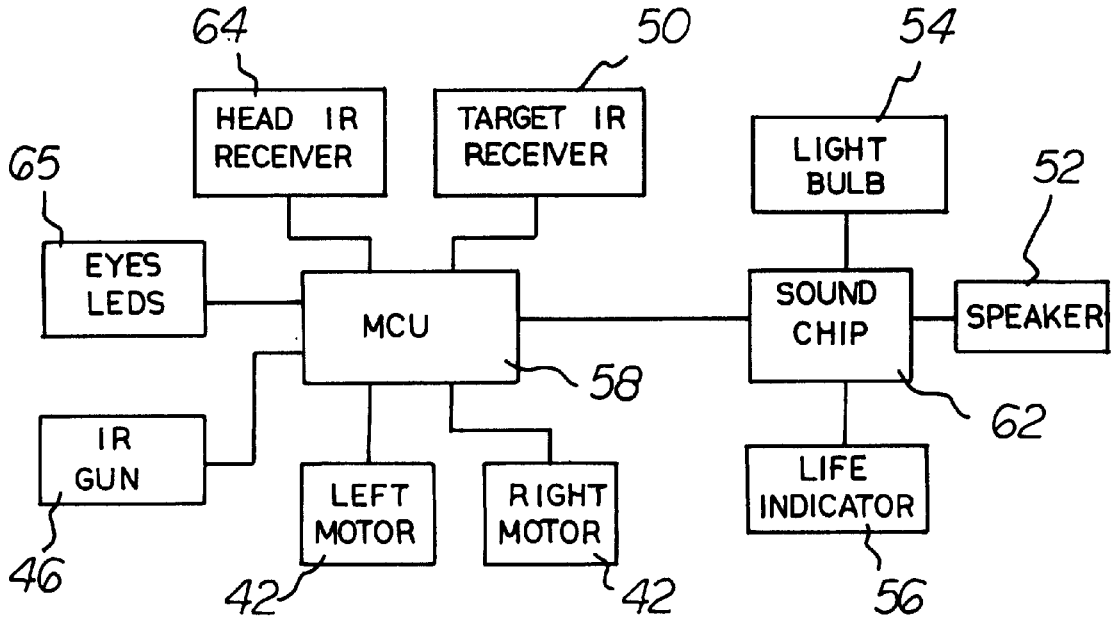
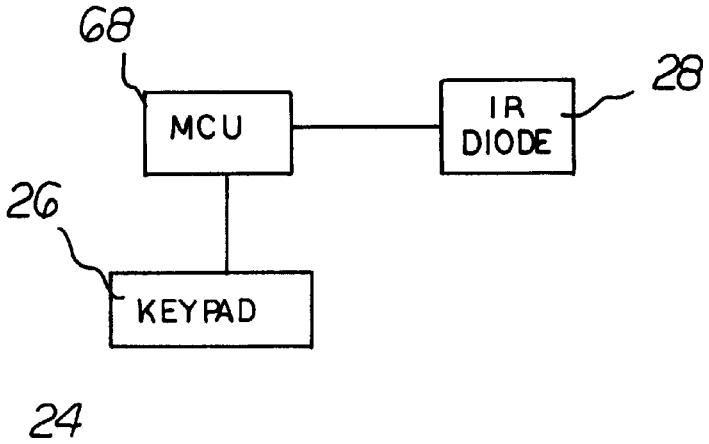
FIG 7

FIG 10
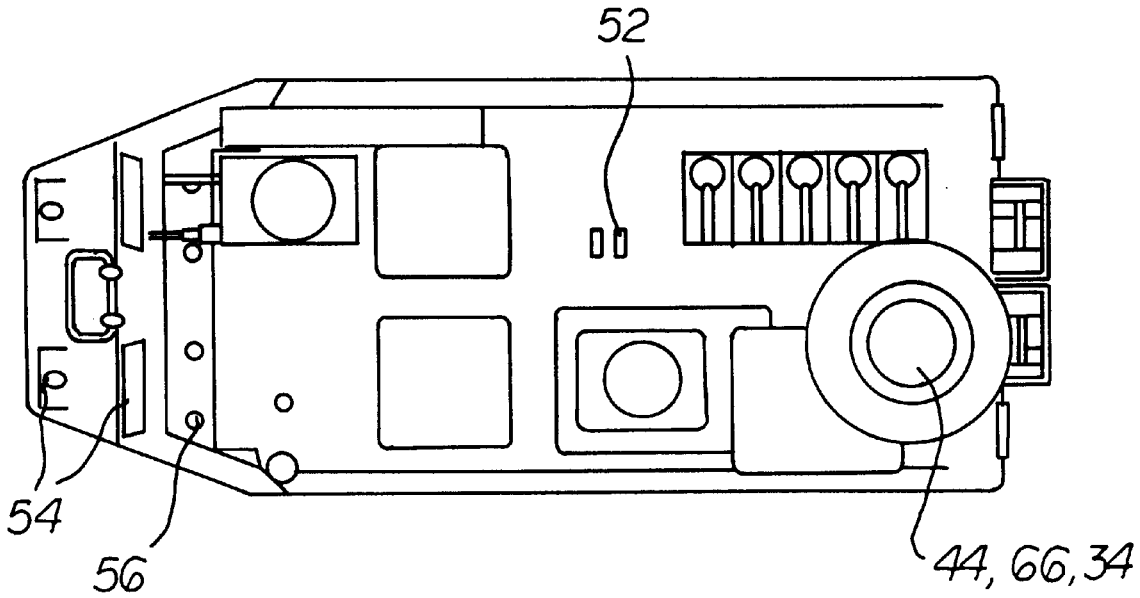
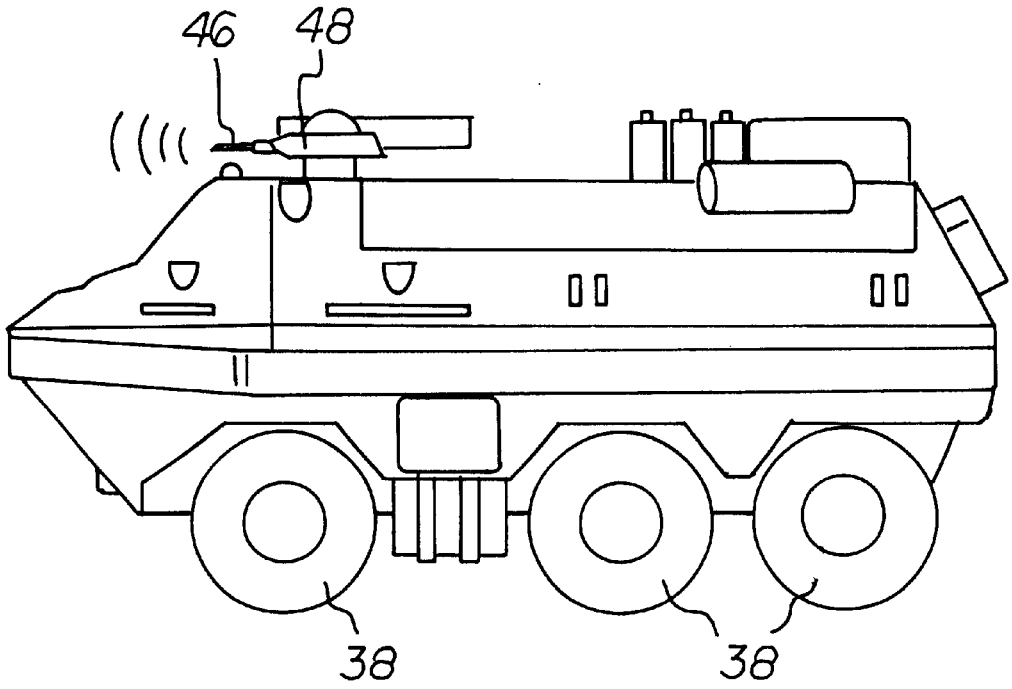
FIG 11

GAMING SYSTEM EMPLOYING SUCCESSIVELY TRANSMITTED INFRA-RED SIGNALS

BACKGROUND OF THE INVENTION

1. Field of the Invention

The present invention relates to a gaming system, and more particularly pertains to a gaming system employing successively transmitted infra-red signals.

2. Description of Related Art

The use of electromagnetic radiation to link hardware units is known in the gamming arts. This technology is typically used in three applications—the transmission of data; the transmission of control commands; and the emulation of shooting between a gun and a target.

Examples of the first two applications include U.S. Pat. No. 5,892,221 to Lev; U.S. Pat. No. 4,938,483 to Yavetz; U.S. Pat. No. 4,930,019 to Chu; and U.S. Pat. No. 4,815,733 to Yokoi. Each of these devices employ signals to control or activate a remote device. In the instance of Lev '221 and Yavetz '483, the signals are used both for controlling a remote device and the simulation of weapons fire. Examples of the third application include U.S. Pat. No. 5,375,847 to Fromm; U.S. Pat. No. 5,904,621 to Small; U.S. Pat. No. 4,772,028 to Rockhold; and U.S. Pat. No. 4,545,583 to Pearman. Each of these systems employs electromagnetic radiation and a radiation detector to simulate the firing of a weapon.

While each of the above referenced systems achieves its particular objective, none of them utilize successively transmitted, or double-hop, infra-red signals. The present systems comprises three units. One unit is a remote controller activated by a player. This remote controller sends infra-red signals corresponding to the commands of the player to the second unit. The second unit receives that infra-red signal, and reacts to it by transmitting a new infra-red signal to the third unit. The third unit receives the second signal, while ignoring the first, and reacts to it by activating various devices.

Therefore, it can be appreciated that there exists a continuing need for a new and improved system for linking hardware units which can be used in gaming systems. In this regard, the present invention substantially fulfills this need.

BRIEF SUMMARY OF THE INVENTION

The general purpose of the present invention is to provide a gaming system that employs a double hop infra-red signal.

To attain this, the present invention essentially comprises a gaming system which utilizes successively transmitted infra-red signals. The system includes two user controlled components which interact with one another. In the preferred embodiment, each component is made up of a hand-held controller and a robot. The controller has both directional controls and a fire control. When a fire control signal is initiated a signal is transmitted to the robot. Upon its reception, a new signal is generated and transmitted by the robot. In this manner, weapons fire is simulated.

It is therefore an object of the present invention to provide a gaming system which allows a user to simulate the firing of a weapon.

It is another object of the present invention to provide a control system which fully utilizes the benefits inherent in infra-red control signals.

It is a further object of the present invention to provide a gaming system wherein the controlled units are capable of detecting infra-red radiation.

An even further object of the present invention is to provide a remotely controlled system wherein infra-red signals are successively transmitted.

Lastly, it is an object of the present invention to provide a gaming system comprising a controller having fire controls which operate to selectively transmit fire signals. The gaming system also includes a controlled unit which has a fire receiver for accepting fire signals from the controller, the fire receiver controlling a weapons transmitter such that the fire controls can be employed to selectively transmit weapons signals.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein:

FIG. 3 is a front plan view of a controller employed in the present invention.

FIG. 4 is a bottom plan view of the controller depicted in FIG. 3.

FIG. 6 is a block diagram illustrating the operation of the robot of the present invention.

FIG. 7 is a block diagram illustrating the operation of the controller of the present invention.

FIG. 10 is a top plan view of a controlled unit which takes the form of an armored personnel carrier.

FIG. 11 is a side elevational view of the controlled unit of FIG. 10.

The same reference numerals refer to the same parts throughout the various Figures.

DETAILED DESCRIPTION OF THE INVENTION

The present invention relates to a gaming system which utilizes successively transmitted infra-red signals. The system includes two user controlled components which interact with one another. In the preferred embodiment, each component is made up of a hand-held controller and a controlled unit. The controller has both directional controls and a fire control. When a fire control signal is initiated a signal is transmitted to the controlled unit. Upon its reception, a new signal is generated and transmitted by the controlled unit. In this manner, weapons fire is simulated. The various details of the present invention, as well as additional embodiments, will be presented hereinafter.

Figure 1:
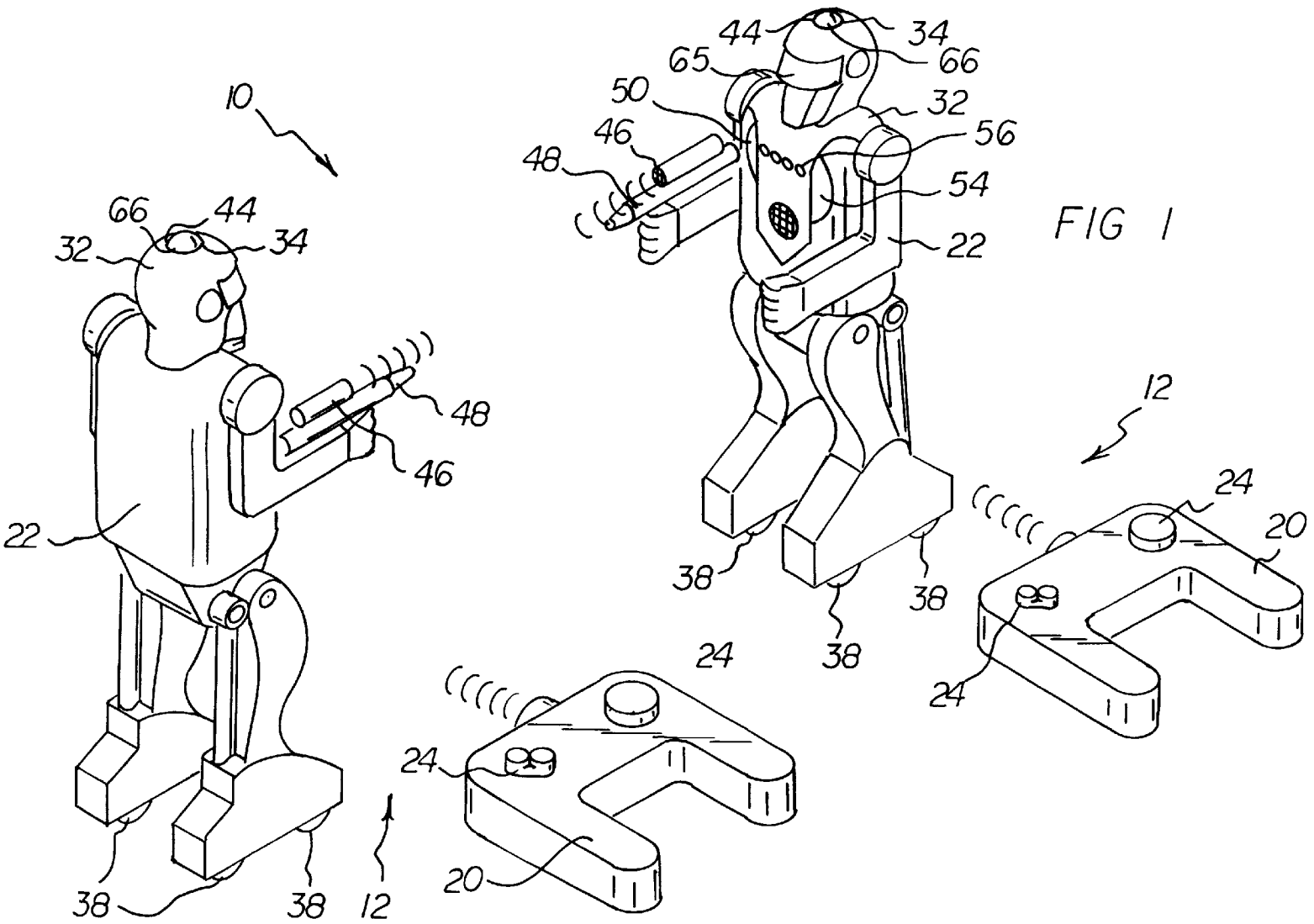
FIG. 1 is an illustration of the gaming system of the present invention.
Figure 2:
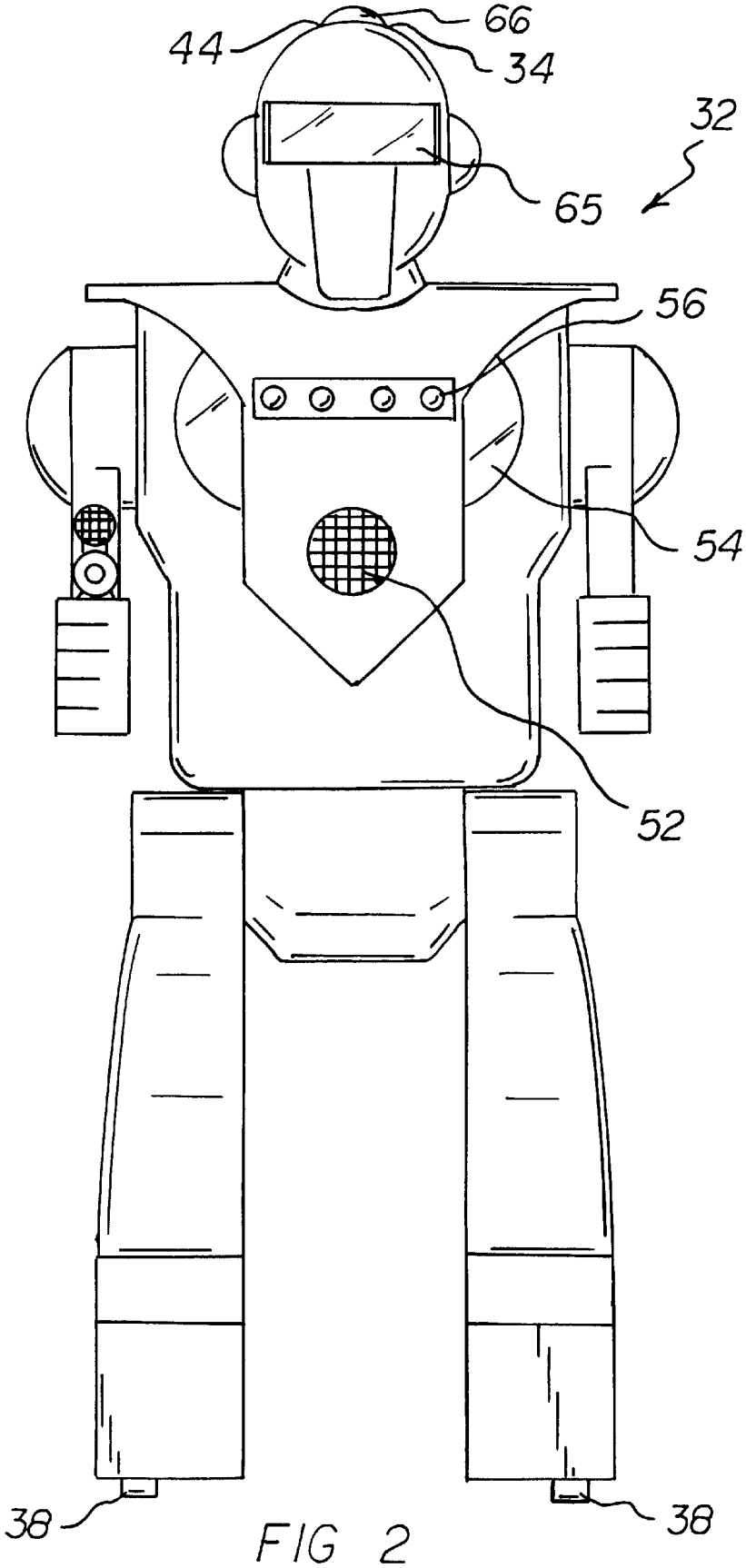
FIG. 2 is elevational view of one of the remote controlled robots employed in the system of the present invention.

FIG. 1 illustrates the preferred embodiment of the system 10 of the present invention. The system 10 includes two components 12, each of which are user controlled. Each component 12 includes a controller 20 and a controlled unit 22. The components 12 are identical to one another so only one will be described in detail.

Each component 12 includes a hand-held controller 20. Preferably, the controller 20 has two directional controls 24, as well as two fire controls 26. The directional controls 24 include a forward/reverse control and a right/left control. The directional controls 24 operate to selectively transmit infra-red directional signals by way of a light emitting diode (LED). In a similar fashion, the two fire controls 26 operate to selectively transmit infra-red fire signals by way of additional LEDs. The exact manner in which the directional and fire controls operate will be described in greater detail hereinafter.

Figure 12:
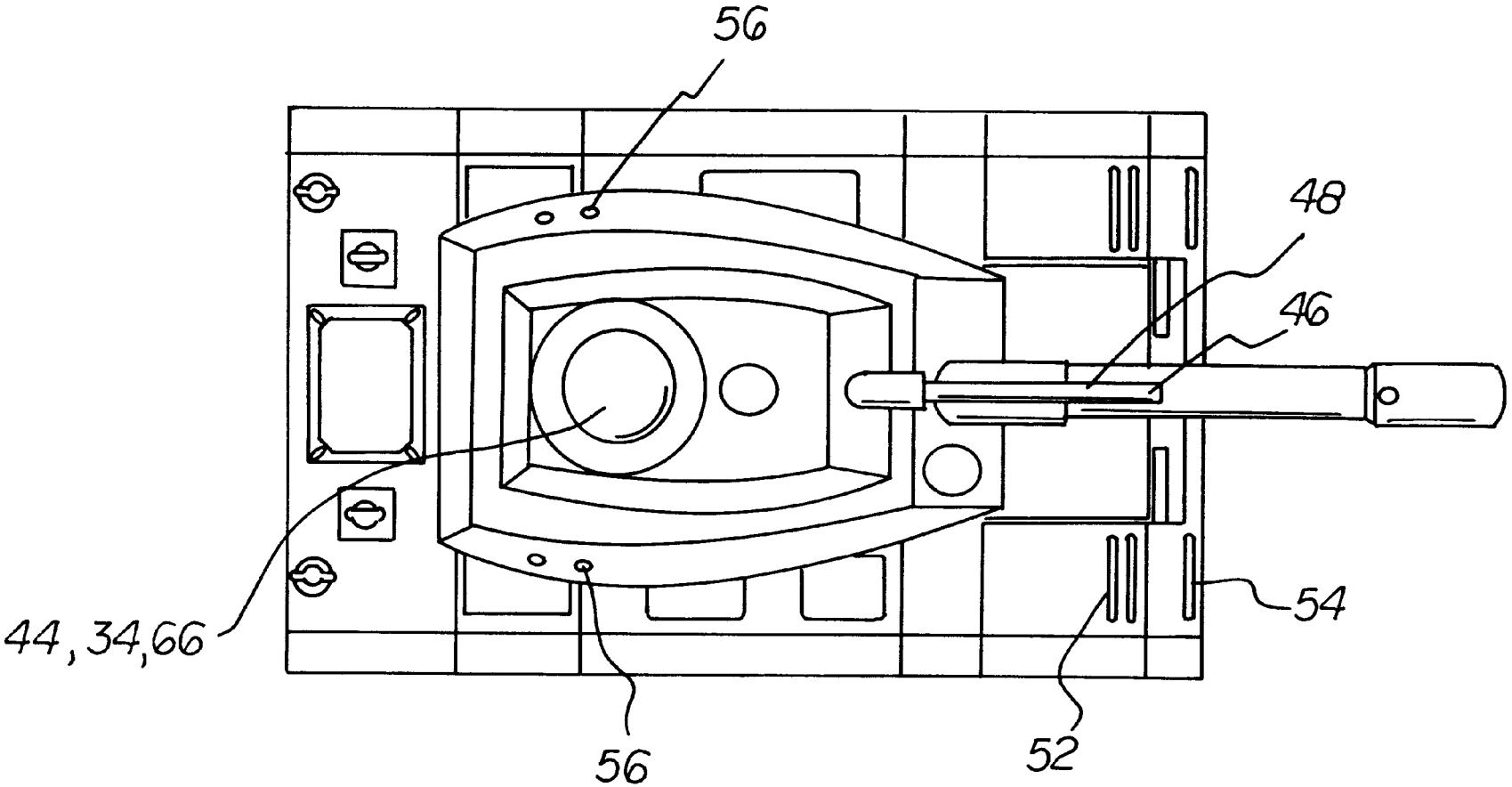
FIG. 12 is a plan view of a controlled unit which takes the form of a tank.

Each of the components further includes a controlled unit 22. In the preferred embodiment, each controlled unit 22 takes the form of a robot 32. However, other embodiments of the controlled unit 22 are within the scope of the present invention. For example, FIGS. 10 and 11 illustrate a controlled unit which takes the form of an armored personnel carrier. FIG. 12 illustrates a controlled unit which takes the form of a tank. Each robot 32 has a directional receiver 34 for accepting directional signals from the controller 20. Additionally, each robot 32 includes motive means 36 controlled by the directional receiver 34. In the preferred embodiment, the motive means 36 takes the form of wheels 38 powered by two electric motors 42. Thus, the directional controls 24 are utilized in selectively operating the motors 42 and wheels 38. Right and left movements are achieved through differential steering. In this manner, the robot 32 can be effectively maneuvered by the controller 20. Each robot 32 also includes a fire receiver 44 for accepting fire signals from the controller 20. The fire receiver 44, in turn, controls the operation of an infra-red weapons transmitter 46. Thus, operation of the fire controls 26 causes the robot's weapons transmitter 46 to emit weapons signals. Preferably, the fire signals and weapons signals are all infra-red signals generated by LEDs. In the preferred embodiment, the weapons transmitter 46 is located in a simulated weapon 48 carried by the robot 32. The robot 32 further includes a weapons signal receiver 50 for detecting weapons signals from other robots 32. This weapons signal receiver 50 operates a speaker 52 and lights 54 when a weapons signal is detected. Furthermore, a series of lights 56 are included to indicate the number of weapons signals which have been detected. The operations of these lights will be described in greater detail hereinafter.

FIG. 6 is a block diagram illustrating the internal components of each controlled unit 22. The two main components of the controlled unit 22 are a primary and secondary micro controller, 58 and 62 respectively. The primary micro controller 58 governs the operation of the head receiver 64 (encompassing both the directional 34 and fire receivers 44), weapons signal (or target) receiver 50, left and right motors 42, eye LED's 65 and weapons transmitter 46 (or ir gun). Thus, when appropriate signals are received by the head receiver 64, the left and right electric motors 42 are operated accordingly. Furthermore, when appropriate signals are received by the head receiver 64 the ir gun is activated to transmit further infra red signals. The secondary micro controller 62 operates an internal light bulbs 54, the series of indicator lights 56 and the speaker 52. Each of these devices is activated when the weapons signal receiver 50 detects a weapons signal from an opposing controlled unit 22. The series of indicator lights 56 are illuminated in accordance with how many weapons signals have been received. In the preferred embodiment, there are four indicator lights. When four weapons signals have been detected the indicator lights 56, internal lights 54, and speaker 52 are activated to announce the end of the game. A reset switch 66 can be depressed to reset the indicator lights 56, thereby giving the controlled unit four more "lives." In the controlled unit 22 embodiment depicted in FIG. 1, the reset switch 66 is mounted on the head of the robot 32.

FIG. 7 is a block diagram illustrating the internal components of the remote controller 20. As indicated, the controller 20 includes a micro controller 68 which controls the keypad devices (24 and 26) and the infra-red LEDs. As indicated, in the preferred embodiment, the keypad devices include two directional controls 24 and two fire controls 26. The devices, in turn, operate diodes with transmit corresponding signals in the infra-red spectrum.

Figure 8:
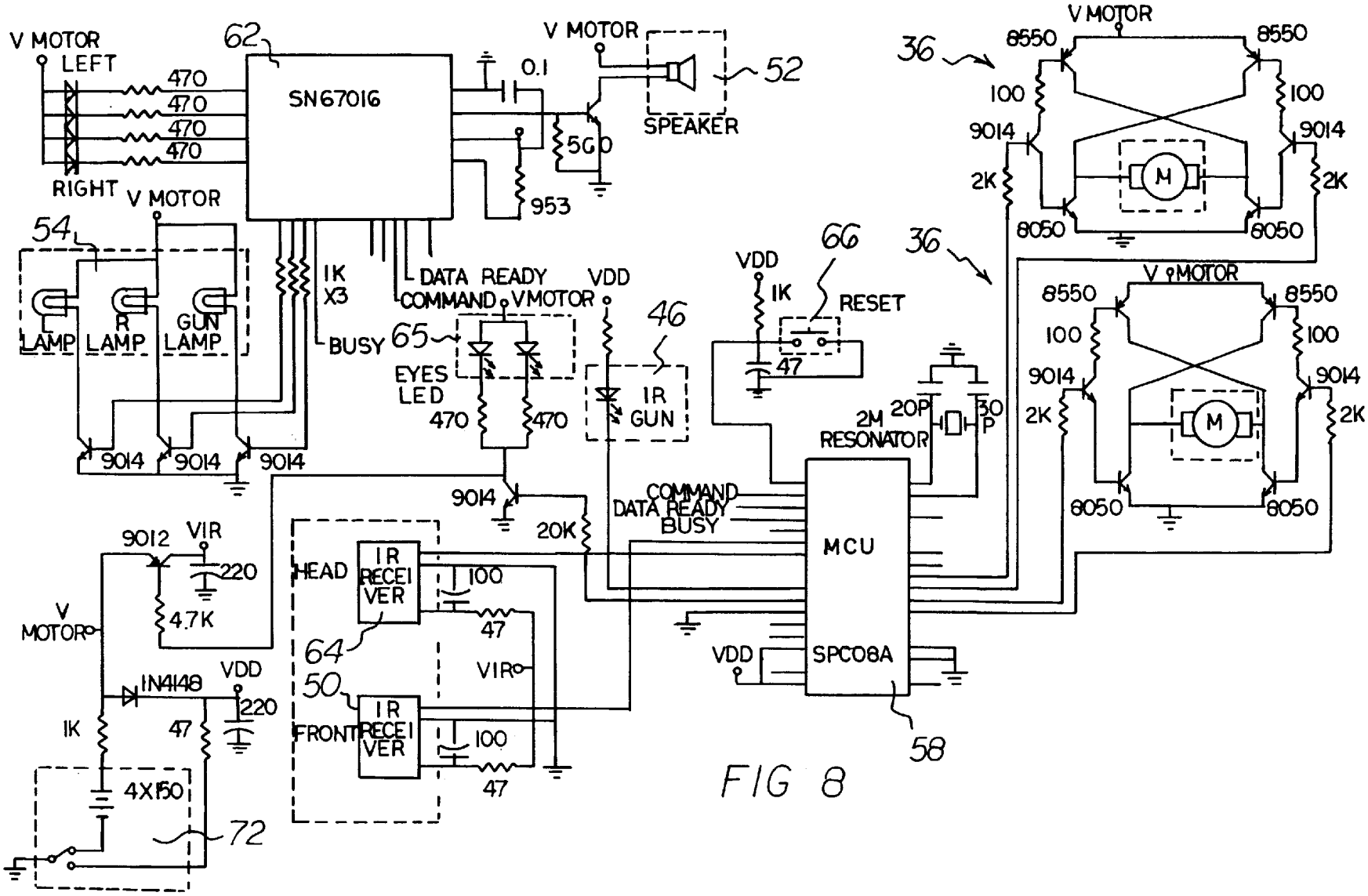
FIG. 8 is a schematic diagram of the electrical components employed by the controlled unit of the present invention.
Figure 9:
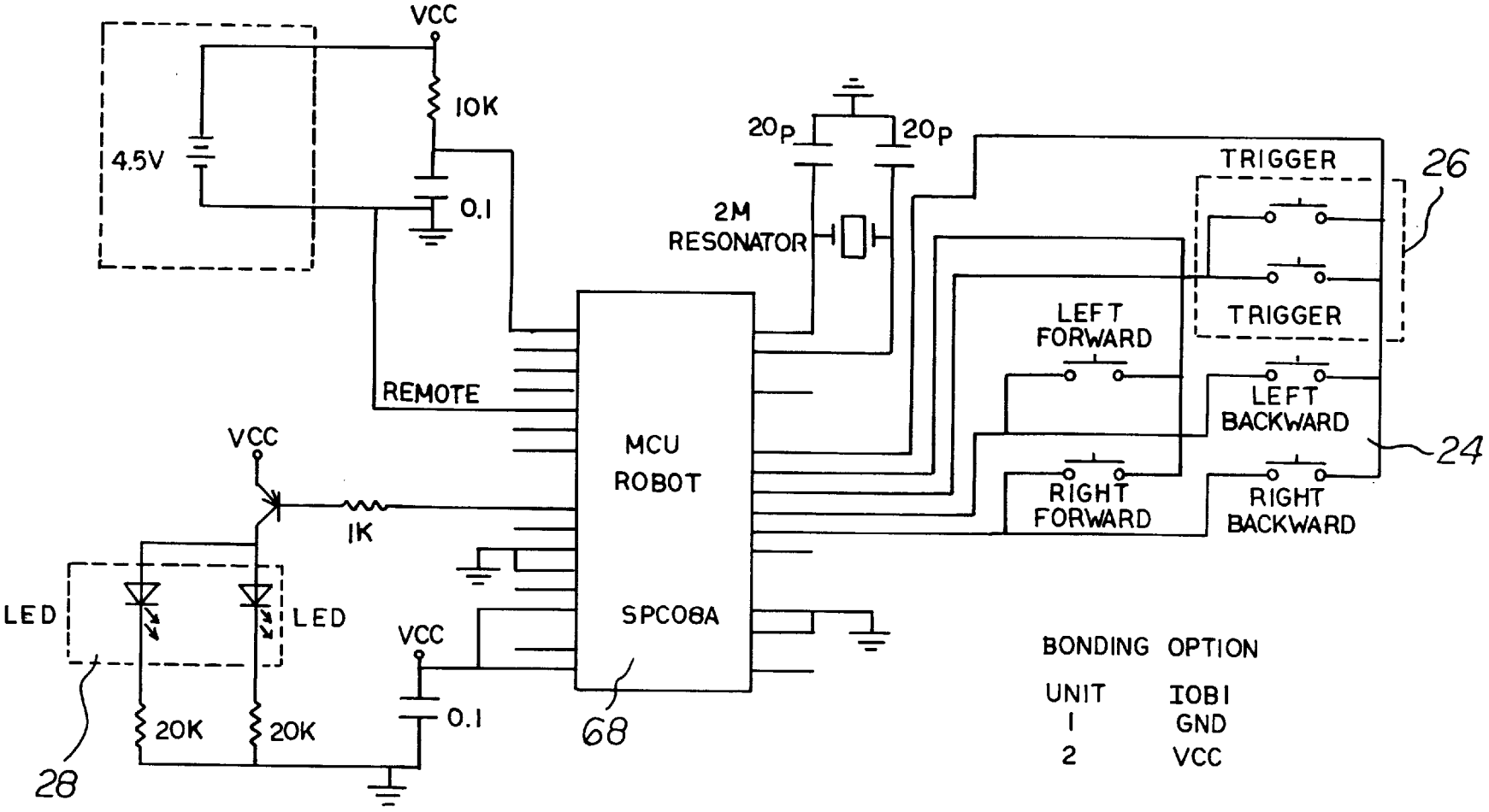
FIG. 9 is a schematic diagram of the electrical components employed by the controller of the present invention.

FIGS. 8 and 9 are more detailed schematics detailing the electrical components of the controlled unit 22 and controller 20 respectively. These schematics are provided as representative of possible controller 20 and controlled unit 22 components. Obviously, other electrical configurations, and components, could readily be employed.

The components of the controlled unit include two electric motor units 42 that are in electrical communication with the primary micro controller 58. The controlled unit 22 also includes a reset switch 66, ir gun 46 and light emitting diode eyes 65, all of which are in electrical communication with the primary micro controller 58. FIG. 8 also indicates two receivers in the head of the robot, a head receiver 64 and a front receiver 50. Both of these are infra-red receivers. As indicated in conjunction with FIG. 6, the head receiver 64 accepts both directional signals and fire signals. The front receiver 50 of FIG. 8 is the weapons receiver for detecting weapons signals from enemy robots. The secondary micro controller 62 is also depicted with its associated speaker 52, lights 54 and motor controls 42. Finally, four 1.5 volt batteries 72 are employed in powering the devices associated with the controlled unit 22.

FIG. 9 illustrates one embodiment of the electrical components associated with the controller 20. The switches for the forward, reverse, right and left controls are depicted. These switches are in electrical communication with the micro controller 68 of the unit. Furthermore, the light emitting diodes (LED) which generate the infra-red signals are also depicted in communication with the micro controller.

In operation, both robots are switched on and placed on a horizontal surface, such as a table or floor. Upon powering up, each robot goes through a cycle wherein the speaker and lights are activated to inform the players that the robot is ready for combat. After the cycle is complete, each user can control the direction of their corresponding robot. Each player attempts to obtain a strategic position on the other player's robot. Namely, each player attempts to prevent their robot's front receiver, or weapons signal receiver, from being exposed to the opposing robot's gun mounted weapons transmitter. A player may push the fire controls to cause their robot's weapons transmitter to operate, thereby simulating the firing of the robot's weapon. Hits on enemy robots are registered when the infra-red weapons signals are detected by the weapons receiver of the opposing robot. When such a signal is detected by a robot it causes the activation of various secondary effects. In the primary embodiment, the secondary effects include the activation of the robot's speaker and lights. This cycle lets the user know his robot has been hit. The series of indicator lights then registers one less life. When a total of four hits are registered the speaker and lights are again activated to signal the end of the game.

Other secondary effects, however, can be triggered by the weapons signal receiver. Namely, secondary effects can include one or more combinations of voices, sounds, lights, smoke, movements of the second unit, movements of figurines and other parts of the second unit, and or any other visual, audible or tactile effects. For example, the tank depicted in FIG. 12 has a secondary effect which includes smoke generated when a hit is detected.

Figure 5:
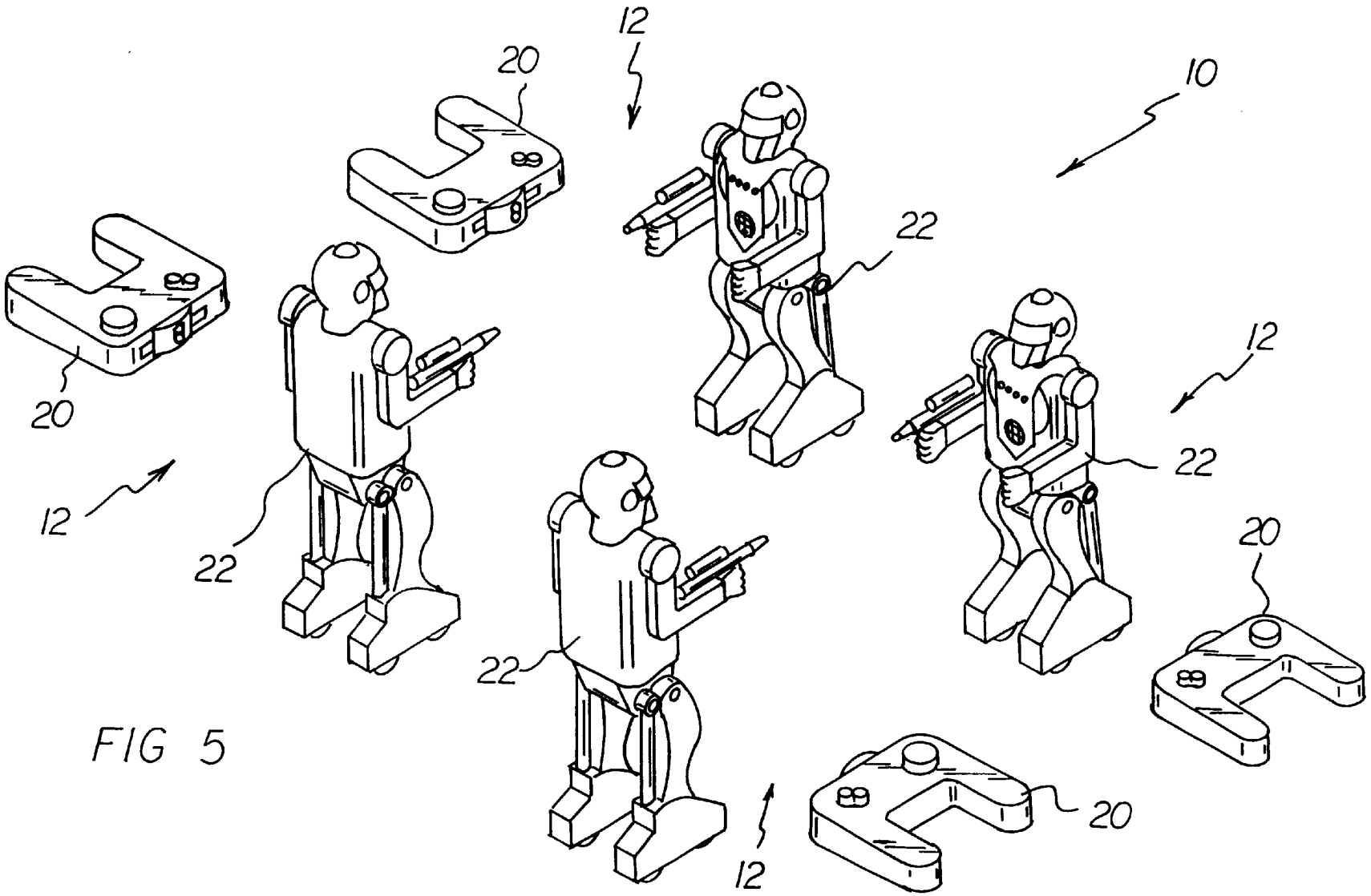
FIG. 5 is an alternative gaming arrangement in accordance with the present invention.

Although the preferred embodiment has been described as a two player game, other embodiments are possible. For example, FIG. 5 illustrates a four player embodiment of the present invention. Obviously, any number of players could participate in the present system.

This detailed description has been provided only for illustrative purposes. It is recognized that other embodiments may be articulated without departing from the objects and scope of the present invention. Any such modifications and variations are meant to be within the scope of the invention as contained within the following claims.

What is claimed as being new and desired to be protected by Letters Patent of the United States is as follows:

1. A gaming system employing successively transmitted infra-red signals comprising:

a first hand-held controller having two directional controls and two fire controls and two light emitting diodes to emit infra-red signals, the directional controls operating to selectively transmit infra-red directional signals from one light emitting diode, the two fire controls operating to selectively transmit infra-red fire signals from the other light emitting diode;

a first robot having a directional receiver for accepting infra-red directional signals from the one diode of the first controller, motive means controlled by the directional receiver such that the directional controls can be employed to maneuver the first robot, a fire receiver for accepting infra-red fire signals from the other diode of the first controller, the fire receiver controlling an infra-red weapons transmitter such that the fire controls can be employed to selectively transmit weapons signals, the first robot further including a weapons signal receiver for detecting infra-red weapons signals from other robots, the weapons signal receiver operating a speaker and lights when a weapons signal is detected, a series of lights to indicate the number of weapons signals which have been detected;

a second hand-held controller having two directional controls and two fire controls and two light emitting diodes to emit infra-red signals, the directional controls operating to selectively transmit infra-red directional signals from one light emitting diode, the two fire controls operating to selectively transmit infra-red fire signals from the other light emitting diode;

a second robot having a directional receiver for accepting infra-red directional signals from the one diode of the second controller, motive means controlled by the directional receiver such that the directional controls can be employed to maneuver the second robot, a fire receiver for accepting infra-red fire signals from the other diode of the second controller, the fire receiver controlling an infra-red weapons transmitter such that the fire controls can be employed to selectively transmit weapons signals, the second robot further including a weapons signal receiver for detecting infra-red weapons signals from other robots, the weapons signal receiver operating a speaker and lights when a weapons signal is detected, a series of lights to indicate the number of weapons signals which have been detected.

2. A gaming system employing successively transmitted infra-red signals comprising:

a first controller having directional controls and fire controls, the directional controls operating to selectively transmit infra-red directional signals from a first light source, the fire controls operating to selectively transmit infra-red fire signals from a second light source;

a fire controlled unit having a directional receiver for accepting directional signals from the first light source of the first controller, motive means controlled by the directional receiver such that the directional controls can be employed to maneuver the first controlled unit, a fire receiver for accepting fire signals from the second light source of the first controller, the fire receiver controlling an infra-red weapons transmitter such that the fire controls can be employed to selectively transmit infra-red weapons signals, the first controlled unit further including a weapons signal receiver for detecting infra-red weapons signals from other robots;

a second controller having directional controls and fire controls, the directional controls operating to selectively transmit infra-red directional signals from a first light source, the fire controls operating to selectively transmit infra-red fire signals from a second light source;

a second controlled unit having a directional receiver for accepting directional signals from the first light source of the second controller, motive means controlled by the directional receiver such that the directional controls can be employed to maneuver the second controlled unit, a fire receiver for accepting fire signals from the second light source of the second controller, the fire receiver controlling an infra-red weapons transmitter such that the fire controls can be employed to selectively transmit infra-red weapons signals, the second controlled unit further including a weapons signal receiver for detecting weapons signals from other robots.

3. The gaming system as described in claim 2 wherein the weapons signal receiver of each controlled unit serves to operate a speaker and lights when a weapon signal is detected.

4. The gaming system as described in claim 2 wherein the controlled unit take the form of robots and the directional controls include forward and reverse controls and right and left controls.

5. The gaming system as described in claim 2 wherein each of the controllers is hand held and includes two directional controls and two fire controls.

6. The gaming system as described in claim 2 wherein each of the controllers is hand held and includes two directional controls and two fire controls.

* * * * *